United States Patent [19]

Gaide

[11] Patent Number: 4,537,143

[45] Date of Patent: Aug. 27, 1985

[54] APPARATUS FOR THE STABILIZING OF THE DIRECTION OF TRAVEL OF WATERCRAFT, SPECIFICALLY A SWORD OR FIN FOR SAILBOARDS

[75] Inventor: Albert Gaide, Monnaz, Switzerland

[73] Assignee: Mistral Windsurfing AG, Nurensdorf, Switzerland

[21] Appl. No.: 394,687

[22] Filed: Jul. 2, 1982

[30] Foreign Application Priority Data

Jul. 3, 1981 [DE] Fed. Rep. of Germany ..... 3126371

[51] Int. Cl.[3] ..... B63B 3/38

[52] U.S. Cl. ..... 114/39; 114/140; 416/132 R; 416/240

[58] Field of Search ..... 114/39, 140, 141, 142, 114/143, 126, 127, 162; 416/132 R, 240; 244/208, 209, 219, 123

[56] References Cited

U.S. PATENT DOCUMENTS

| | | | |
|---|---|---|---|
| 3,753,415 | 8/1973 | Burtis | 114/126 |
| 4,074,646 | 2/1978 | Dorfman et al. | 114/39 |
| 4,429,844 | 2/1984 | Brown et al. | 244/219 |

FOREIGN PATENT DOCUMENTS

| | | | |
|---|---|---|---|
| 2937928 | 9/1979 | Fed. Rep. of Germany | 114/140 |
| 2922629 | 12/1980 | Fed. Rep. of Germany | 114/140 |
| 1491403 | 1/1967 | France | 114/140 |
| 384587 | 12/1932 | United Kingdom | 244/123 |
| 1406240 | 8/1975 | United Kingdom | 244/219 |
| 1567395 | 3/1977 | United Kingdom | 114/140 |

*Primary Examiner*—Trygve M. Blix
*Assistant Examiner*—Edwin L. Swinehart
*Attorney, Agent, or Firm*—Armstrong, Nikaido, Marmelstein & Kubovcik

[57] ABSTRACT

The present invention relates to an apparatus for the stabilizing of the direction of travel of watercraft. The invention relates specifically to a sword or fin for sailboards. In order to allow the wind-profile like shape of the apparatus to adjust itself in accordance with a prevailing velocity of flow or a prevailing flow thereagainst, the apparatus comprises two deformable side walls which are mounted to a rigid and stiff center wall exclusively at an area located at the leading edge thereof in relation to the direction of flow. These side walls enclose together with the two oppositely arranged surfaces of the center wall two void spaces. Depending on the prevailing pressure situations between the luff side and the leeward side, an optimal hydrodynamic flow profile is automatically generated. According to preferred embodiments, the trailing edge of the apparatus comprises vacuum pumps which communicate with the void spaces, which vacuum pumps are present in form of water jet pumps. This allows additionally a controlling of the profile corresponding and in dependence from the velocity of flow.

15 Claims, 18 Drawing Figures

APPARATUS FOR THE STABILIZING OF THE DIRECTION OF TRAVEL OF WATERCRAFT, SPECIFICALLY A SWORD OR FIN FOR SAILBOARDS

BACKGROUND OF THE INVENTION

1. Field of the Invention

The present invention relates to an apparatus for the stabilizing of the direction of travel of watercraft, specifically a sword or fin for sailboards having a guide plate extending from the bottom side of the watercraft into the water, which guide plate has a symmetrical airfoil profile cross-sectional shape.

2. Description of the Prior Art

Such apparatuses which are given generally the shape of swords or tail fins give rise to various problems in connection with wind surfing boards and specifically at high velocities. The profile of the fin or sword, respectively, of sailboards or generally watercraft is designed similar as is the case with aircraft wings with the aim of reaching an as small as possible flow resistance and also of achieving an as large as possible uplift of such profile. The uplift of the sword or fin, respectively, counteracts the drifting of the wind surfer due to the force components of the sail. An optimal design of the lift as well as the optimal design of an as small as possible resistance depend, however, at a prevailing profile on the relative velocity of the flow of water relative to the profile. Accordingly, every profile has an optimal velocity, at which the largest possible lift may be achieved simultaneously with an as small as possible flow resistance in case of a laminar flow. Such optimization calculations can be solved in case of designing profiles of turbine blades, aircraft wings on the base of predetermined nominal velocities. Such solutions are, however, not suitable for the broad range of various velocities of such watercraft. A basic rule for bodies, around which a flow prevails is that the larger the relative velocity is the smaller the depth of profile must be, neglecting a change of the picture or aspect, respectively, ratio.

The difficulties present at watercraft of above mentioned design are increased due to the fact that the profiles defining the guiding wings are usually streamed against obliquely except in the case of a downwind run because due to the always present drifting watercraft and wind surfing boards move somewhat obliquely through the water. This leads now to the fact that relative to the two sides of the profile of these guide surfaces and in spite of the fact that they are given a symmetrical profile shape a positive pressure side and a negative pressure side exist. These pressure differences may thereby rise to such an extent that during high velocities such as can be presently reached specifically with wind surfing boards cavitations may be generated at the fins and at the sword which lead to a sudden veering of the course of the sailboards (see Windsurfing Magazine "Surf", July 1981, pages 74 ff.).

SUMMARY OF THE INVENTION

Hence, based on above facts it is a general object of the present invention to provide an improved apparatus for the stabilizing of the direction of travel of watercraft, in which an optimal profile of the guide plate exposed at all sides to a flow shapes itself automatically in accordance with prevailing flow conditions to an optimal profile.

A further object is to provide an apparatus for the stabilizing of the direction of travel of watercraft which comprises two independently from each other flexibly deformable side walls defining the profile of the guide plate, the shape of said side walls in the prestressed condition due to their internal elasticity corresponding to an optimal profile for low flow velocities, which side walls are designed such that they are deformable in accordance with prevailing pressures which change due to the velocity of flow and/or due to the angle of flow thereagainst.

According to a preferred embodiment of the invention the flexible side walls are mounted to a relative to the direction of flow leading edge of a rigid center wall, which flexible side walls abut due to their inherent elasticity laterally at the area of the trailing edge described by the center wall of the apparatus, which side walls define together with the two oppositely located surfaces of the center wall two substantially closed void spaces or cavities, respectively. This embodiment secures the necessary high lateral stiffness of such guide plates also during or after the change of the prevailing optimal profile.

A further preferred embodiment encompasses recesses which are arranged at the area defined by the lines of contact between the flexible side walls and the center wall, which recesses are dimensioned such that they define together with the outer current of the water water jet pumps which generate a negative pressure inside the void spaces. The advantage of this embodiment is that due to the negative pressure generated in the void spaces or cavities, respectively, the profile will be pulled towards a flat condition by means of a positive control aiming at optimizing the profile at an increased velocity of flow relative to the guide surface. In addition the wall thicknesses of the side walls can be dimensioned accordingly such that simultaneously therewith a shifting of the area of the largest depth of curvature is arrived at.

To this end it is also possible to manufacture the center wall from aluminium or a similar material and to manufacture the side walls from a rubber or a plastics material. The void spaces or cavities, respectively, may be empty or may be filled at least in part by a compressible material.

For ease of manufacture, in a further preferred embodiment an integral member is provided which comprises both side walls which are provided with a profiled channel in the general area of the leading edge and located at their inner side, which profiled channel receives a correspondingly profiled section of the center wall. This allows this specific apparatus of the invention's embodiment to be assembled merely in that mentioned integral part is slid onto the center wall. A further advantage of this design is that in case the center wall is rigidly connected to the sailboards, the side walls will be quite easily exchangeable.

Due to the fact that the center wall defines two void or hollow, respectively, spaces which are separate from each other and may be acted upon at different pressures, the side walls may be deformed individually and asymmetrically.

According to a further embodiment the recesses may be arranged directly in the side walls or in the center wall such to achieve the water jet pump effect for generating the sought negative pressure in the void spaces.

It also is possible to arrange such recesses according to a further embodiment in the side walls as well as in the center wall at the trailing edge thereof such that both void spaces can simultaneously be acted upon by the vacuum pumps formed therewith. In such case the advantageous asymmetric deformation of the profile existing if it is obliquely streamed against is determined by the differing outer pressures or relative pressures, respectively, acting at both sides of the profile because in such case the negative pressure generated will have about the same value in both void spaces.

In a further modified embodiment of the invention the center wall can be provided additionally with laterally located supports which limit the minimal profile attainable with this design. Thereby it is possible that either the center wall itself comprises a flat profile or the center wall may be provided with corresponding supporting ribs.

A specific advantageous embodiment of the invention can be arrived at in that the trailing edges of the side walls abutting the center wall are given at the same time a valve function. To this end the inner sides of the trailing edges of the side walls are provided in accordance with a preferred embodiment with channels which upon a bulging of the profile at a corresponding maximal position shut the void spaces individually off against the water jet pumps formed by the recess in the center wall. This will allow that the profile can bulge at one side only and may specifically if flowed against at an oblique angle bulge further without having to overcome a negative pressure generated inside of the void space which may be advantageous regarding avoiding of cavitation effects such as will be explained more in detail in the following description of preferred embodiments.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
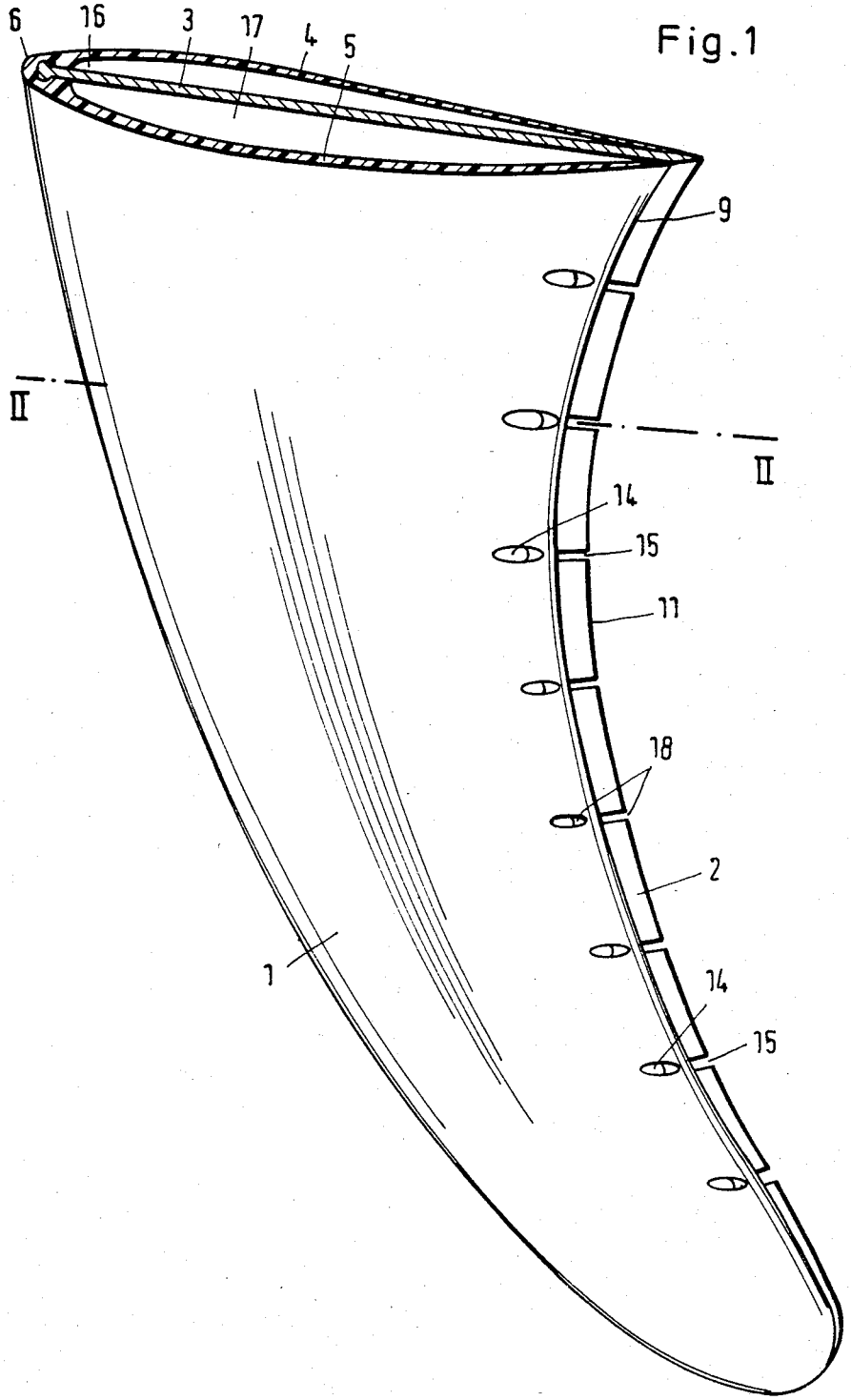
FIG. 1 is a perspective side view of a first embodiment of the apparatus in accordance with the invention embodied as stern or aft, respectively, fin.

The figures disclose an embodiment of the invention in form of an aft or stern, respectively, fin 1 of a sailboards. It must be clearly noted that the structual principles described hereinafter are also applicable at swords or other guide surfaces. Due to the hydrodynamics of symmetrical profiles flowed against at an oblique angle a number of difficulties arise due to the pressure differences generated at the profile exposed at both areas to a flow which pressure differences arise due to the oblique flow, which problems will exist specifically in case of sailboards. Sailboards are always subject to a leeway drift except during a downwind run such as is the case at all sailing vessels. Due to this drift the sword as well as the fin are flowed against at an oblique angle such that a positive pressure is generated leeward and a negative pressure is generated at the luff side, the weather side. This lift is desirable in order to gain an as high as possible lift towards the luff side corresponding to the principles of the known aero- and hydromechanical principles; such lift is desirable because it is a force counteracting the force generated by the wind and transmitted by the sail. However, the negative pressure generated at the sword at the luff side leads at high velocities to a capsizing due to the hinge connection between board and rig, which capsizing is due to the fact that due to the lift generated at the sword the sailboards will upend. High velocities directed at an oblique angle to the aft fins lead to the so-called spinout, i.e. a sudden veering of course of the stern of the board due to cavitation effects present at the surface of the fin.

These two above described difficulties are solved by the construction and design of such guiding planes having a profile which varies in accordance with the prevailing pressure situations at both sides thereof in accordance with the various embodiments as shown in the FIGS. 1 to 15.

The aft fin shown in various embodiments in the FIGS. 1 to 15 is built up or constructed, respectively, from basically the same individual structural elements in all shown embodiments whereby the various embodiments differ merely in regard to the shape of the preferably at the area of the trailing edge 2 of the fin 1 located recesses having a function of a water jet pump. The basic structure and setup will now be described with reference to FIGS. 1–3. The fin shown in FIGS. 1–3 comprises a rigid center wall 3, which may have the form of a flat plate. This rigid center wall 3 is mounted in a way and by means known as such to a watercraft (not particularly shown), specifically to a sailboard. At both sides of this rigid center wall 3 a flexible side wall 4 and 5 each is located which in the rest position, i.e. not subject to any current shown, has a cross section similar to a symmetrical airfoil profile having a comparatively large or high, respectively, depth of profile. In accordance with the preferred embodiment the two side walls 4 and 5 are manufactured in shape of an integral formed article in that they are connected to each other at the leading edge 6 regarding the direction of incoming flow, at which area a reinforcement 7 is present. The formed body 8 arrived at therewith is preferably manufactured out of rubber or an elastic plastics material.

Due to the effect of the elasticity the two trailing edges of the side walls 4 and 5 abut at the sides the rigid center wall 3 at the general area of its trailing edge 11.

The connection between the formed body 8 and the center wall 3 shown in the embodiments according to the various figures is achieved in that the formed body 8 comprises a profiled channel 12 located within the reinforcement 7, which profiled channel 12 is form closed slid upon a profile section 13 of the center wall 3. The center wall 3 may preferably be manufactured out of aluminium.

Figure 2:
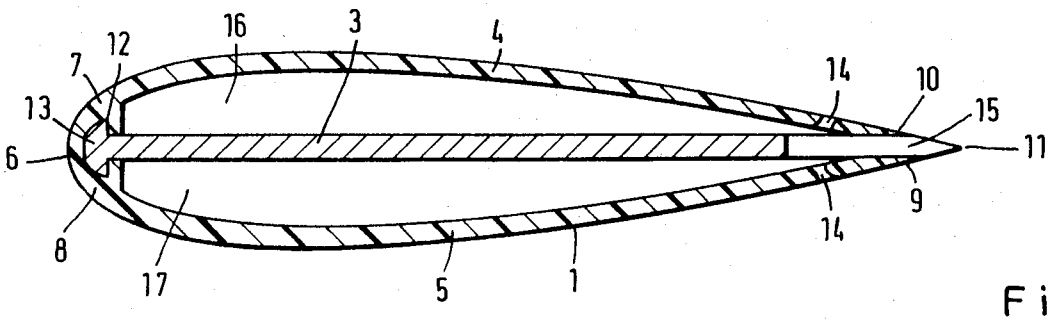
FIG. 2 is a view of the section along line II—II of FIG. 1.
Figure 3:
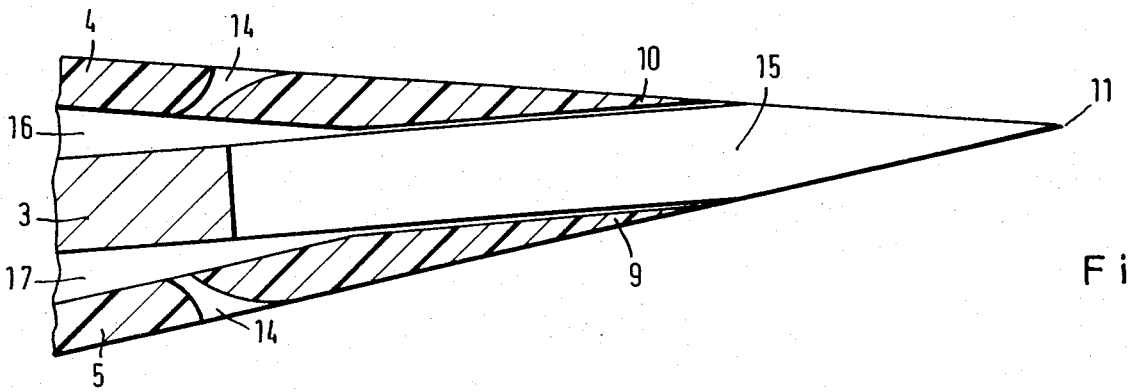
FIG. 3 shows on an increased scale a section of the trailing edge of FIG. 2.

The above described structure is in the sense of a solution of the objects of the invention already functionable without the recesses at the general area of the trailing edge 2 of the fin 1, which recesses are shown already in FIGS. 1 to 3. The side walls 4 and 5 define relative to the center wall 3 two hollow or void spaces or cavities, respectively, 16, 17 which are separated from each other such as shown in the drawings whereby the profile shape of these void spaces 16, 17 is variable due to the flexibility of the side walls 4 and 5. If, for instance, the described structure is flowed against at an oblique angle, the pressure at the side of the side wall 4 increases and at the same time the same flow will generate a negative pressure at the side of the side wall 5 such that both side walls will deform correspondingly at a simultaneous as high as possible maintenance of a laminar flow such that a asymmetrical profile is arrived at, which profile is similar to the profile of the wing of an aircraft. Such a profile leads to an increase of the lift at the luff side and at the same time the outwards bulging of the side wall 5 at the negative pressure side of the FIG. 1 acts against mentioned cavitation effects.

According to the preferred embodiment of the invention vacuum pumps are located additionally in the general area of the trailing edge 2, which vacuum pumps are generally defined by the reference numeral 18, which vacuum pumps generate in the void spaces 16, 17 a negative pressure in accordance with the velocity of flow of the water flowing along both sides of the profile, i.e. in accordance with the velocity of the vehicle itself. The vacuum pumps 18 are designed as water jet pumps. According to the embodiment shown in FIGS. 1 to 3 these vacuum pumps 18 are given the shape of recesses 14 arranged in the side walls 4 and 5, respectively, and the recesses 15 arranged in the trailing edge 8 of the center wall 3. The principles of operation which then specifically can be clearly seen out of FIG. 3 are known to the person skilled in the art of aero- and hydrodynamics. It is obvious that this leads to a change of the profile described by the side walls 4 and 5, which change is in a direct relation to the relative velocity and is secured when flowed against in an axiparallel direction or at an oblique angle.

The recesses 14 arranged in the side walls 4 and 5 have a jet like shape such as shown and act against a too large bulging at the side of negative pressure of the profile in case it is flowed against at an oblique angle.

Figure 4:
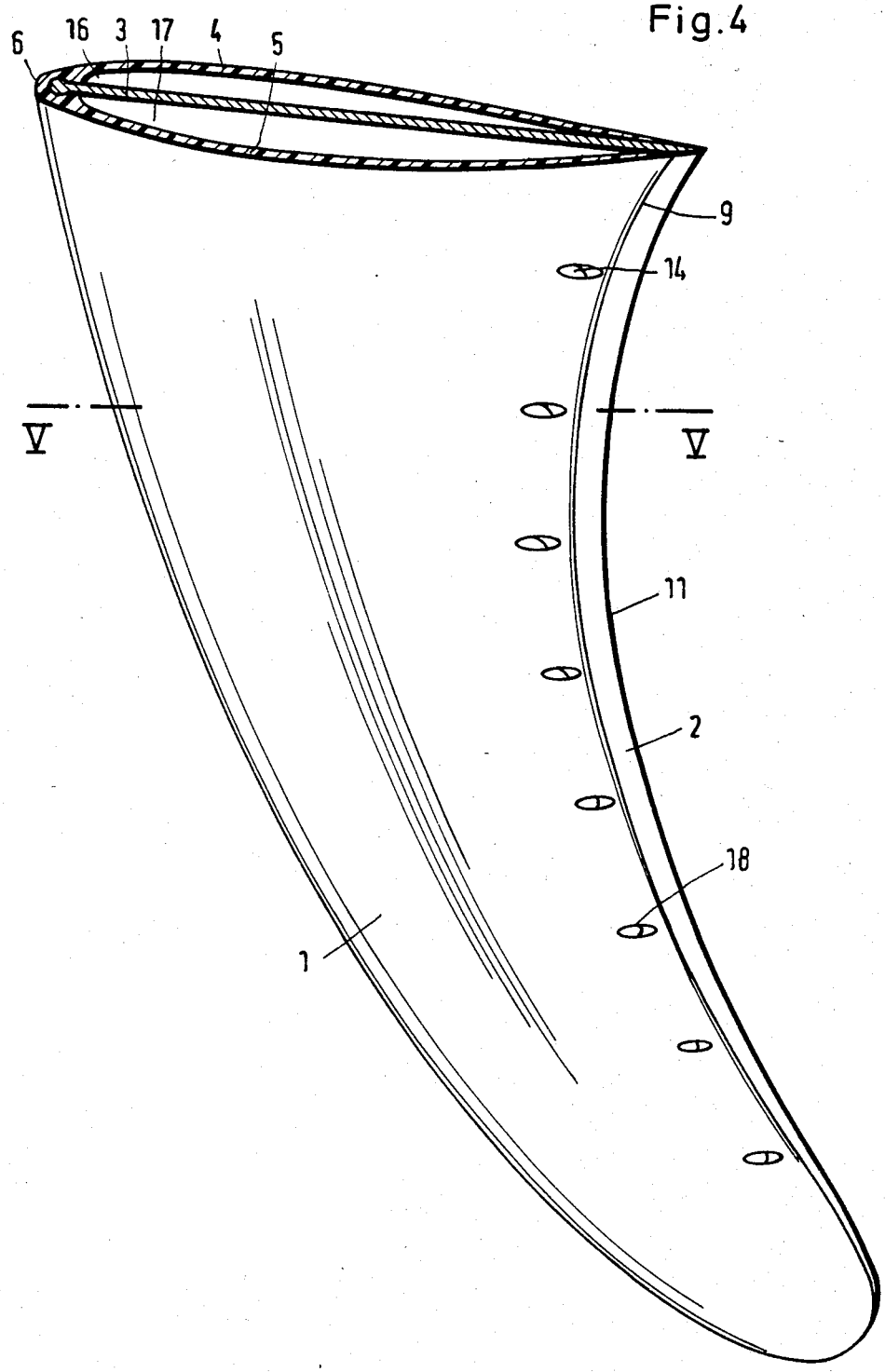
FIG. 4 is a view of a modified embodiment of FIG. 1.
Figure 5:
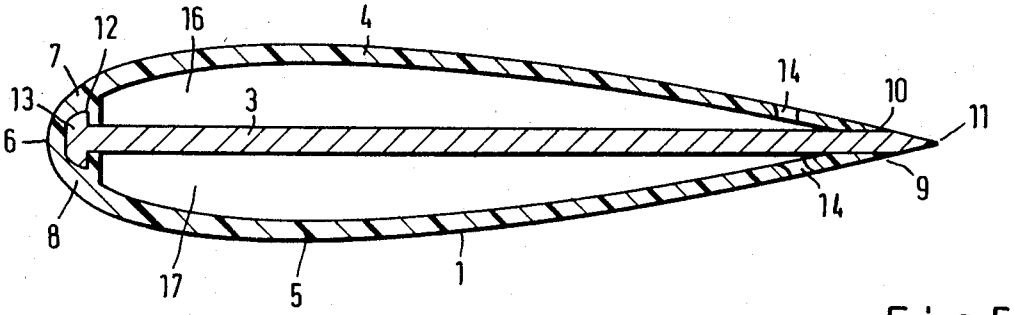
FIG. 5 is a view of a section along line V—V of FIG. 4.
Figure 6:
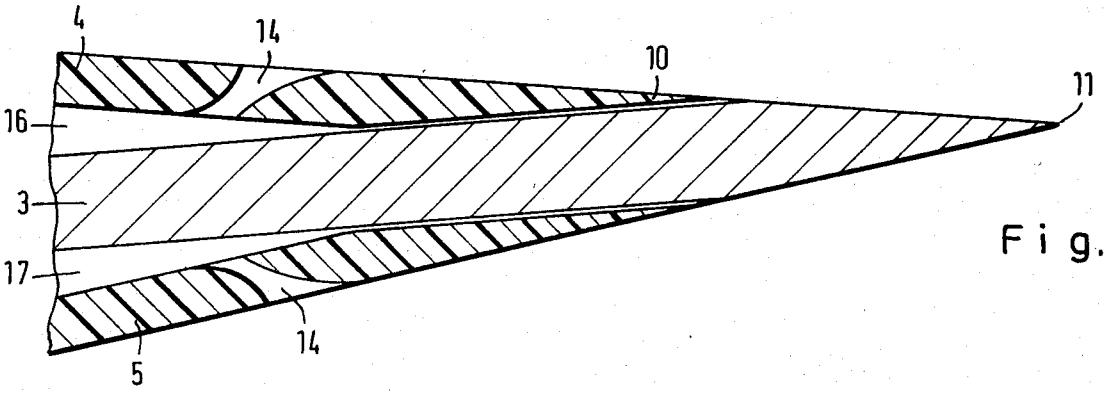
FIG. 6 shows on an enlarged scale a section of the trailing edge of FIG. 5.

In the embodiment according to FIGS. 4, 5 and 6 the recesses 14 are located only in the side walls 4 and 5 such that the center wall 3 features an uninterrupted profiled trailing edge 11. Also in this case the recesses 14 are given a jet like shape. Regarding further structural details and regarding the principles of operation attention is drawn to the description of the embodiments according to FIGS. 1 to 3.

Figure 7:
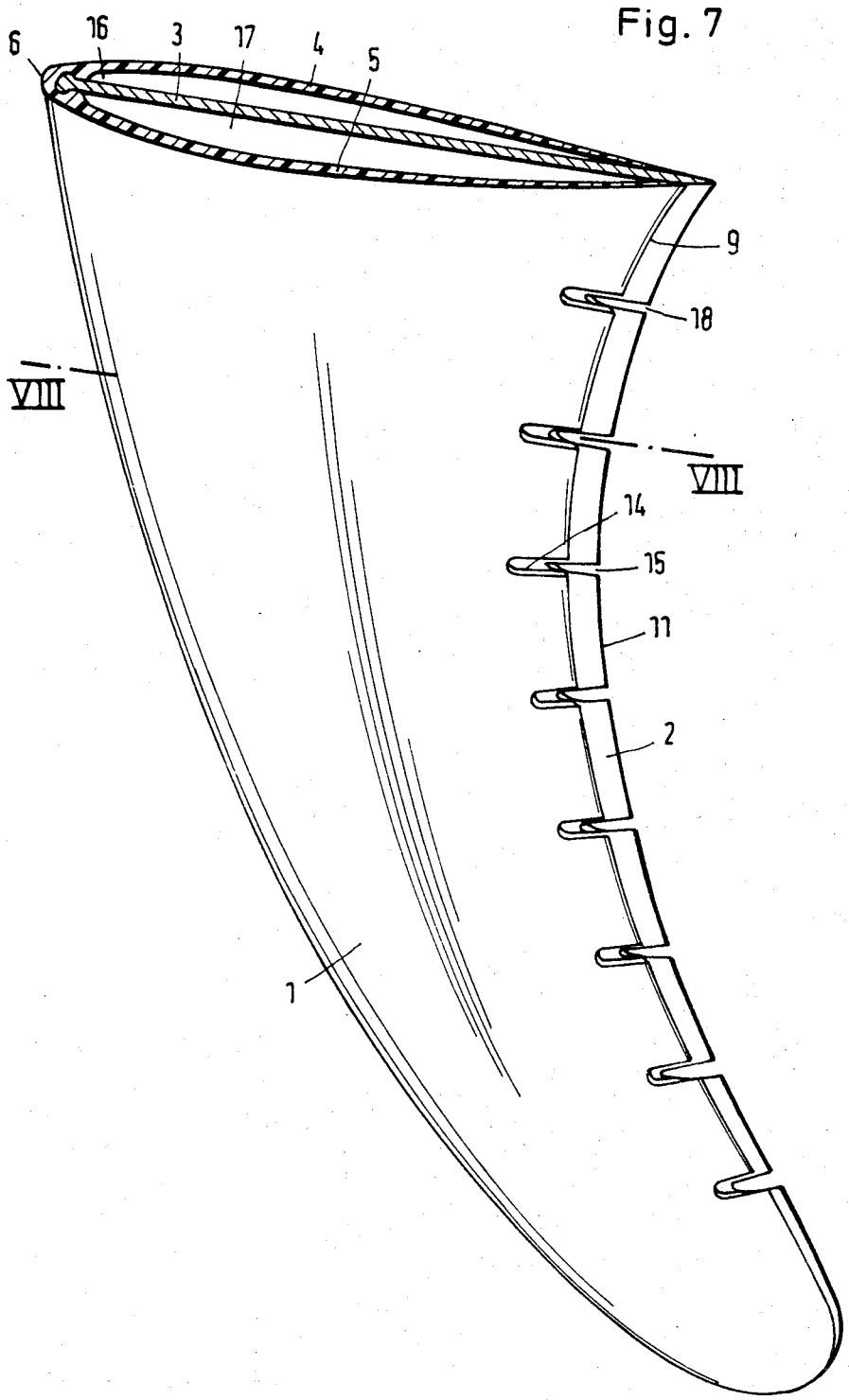
FIG. 7 is a view of a further modified embodiment similar to FIG. 1.
Figure 8:
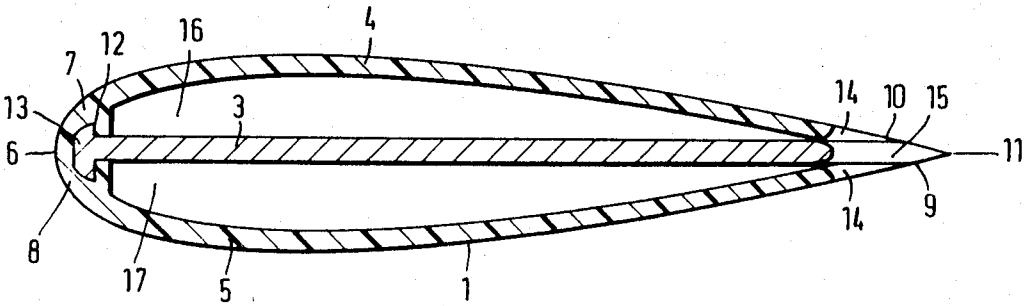
FIG. 8 is a section along the line VIII—VIII of FIG. 7.
Figure 9:
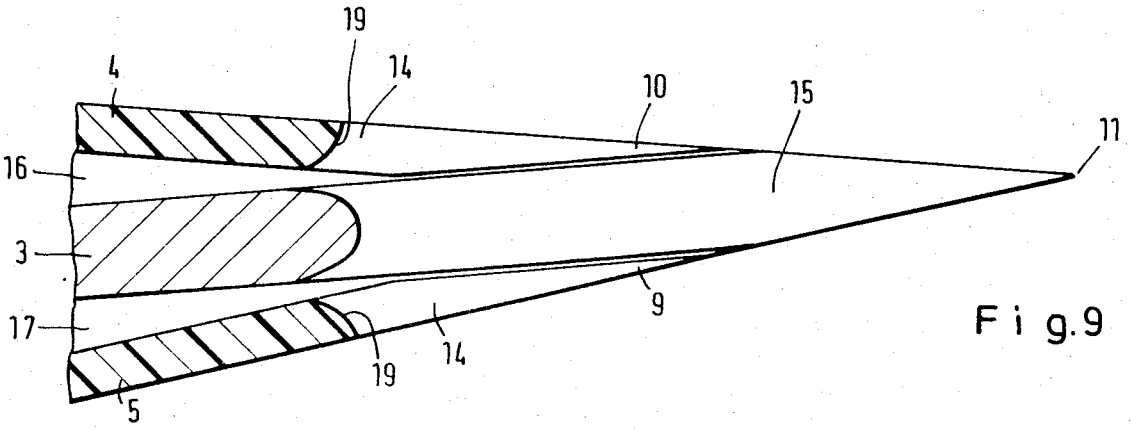
FIG. 9 shows on an enlarged scale a view of a section of a trailing edge of the embodiment of FIG. 8.
Figure 10:
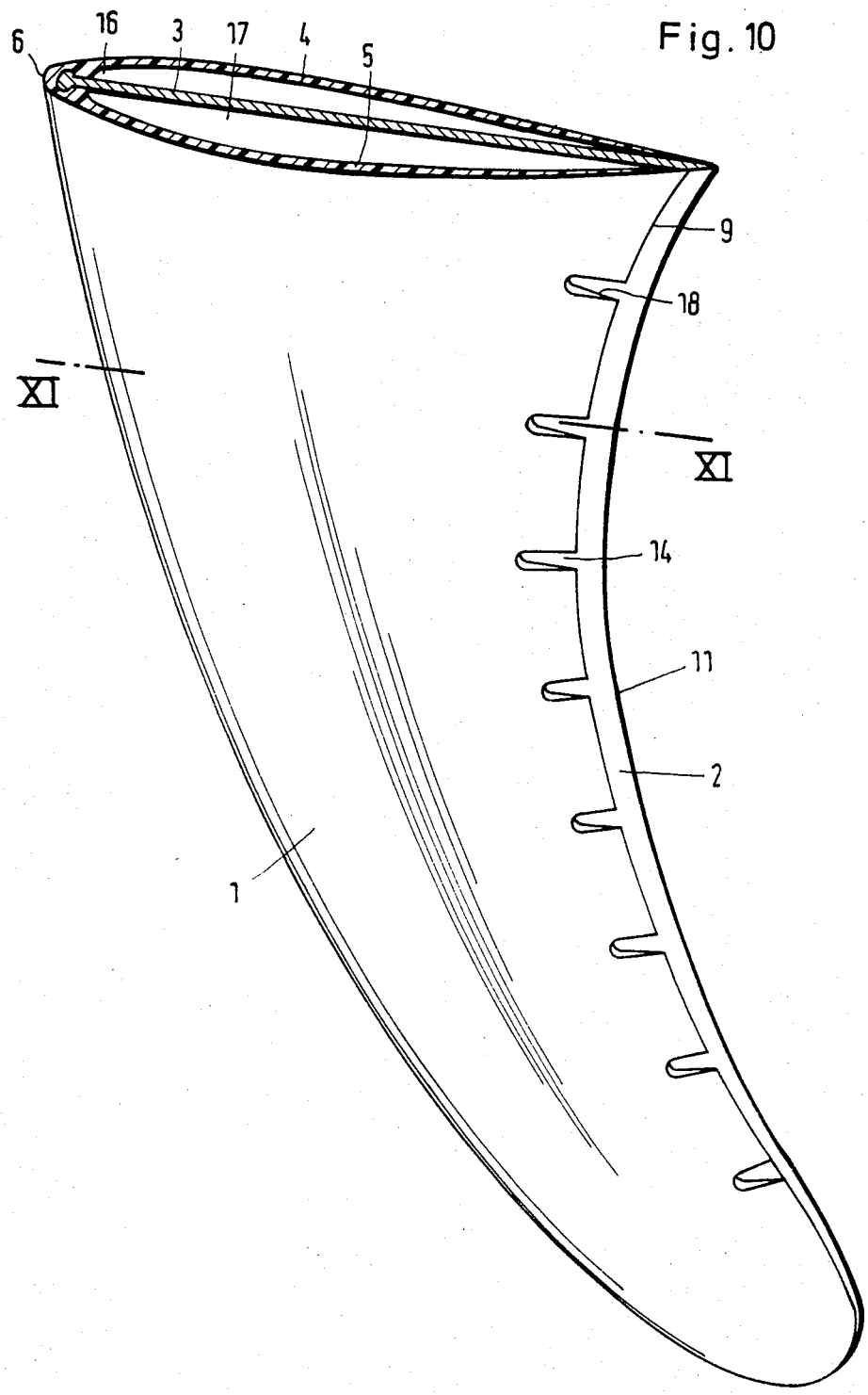
FIG. 10 shows a further embodiment of the invention in a view similar to the view of FIG. 1.
Figure 11:
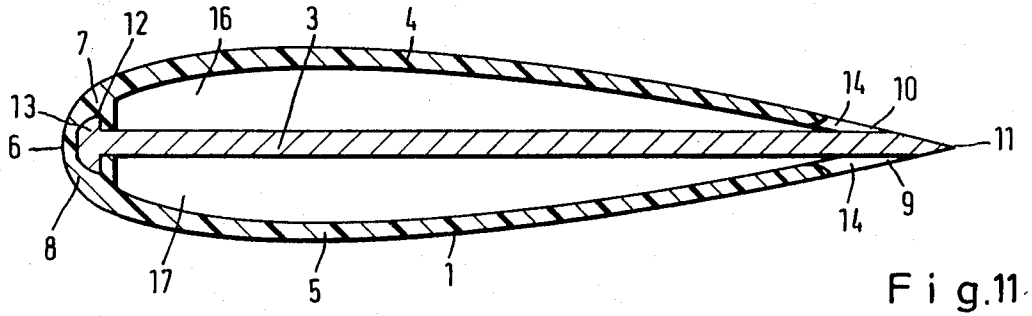
FIG. 11 is the view of a section along line XI—XI of FIG. 10.
Figure 12:
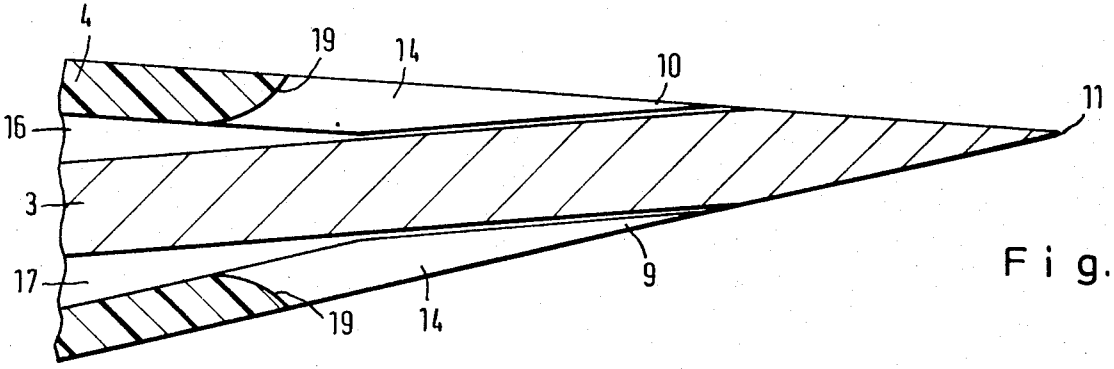
FIG. 12 shows on an enlarged scale a section of the trailing edge of the embodiment of FIG. 11.

According to the embodiment shown in FIGS. 7 to 9 the recesses 14 pass into recesses 15 if viewed in section and in accordance with FIG. 9, such that a common vacuum pump 18 is present influencing both void spaces 16 and 17. If the profile is flowed against at an oblique angle in accordance with FIGS. 7 to 9, the desired asymmetric deformation is arrived at due to the different prevailing pressures at the luff side and lee side, respectively. The other structural details of the embodiment shown in FIGS. 7 to 9 correspond to the embodiment of FIGS. 1 to 3 such that reference can be made to the above description thereof. It merely must be noted that the wall of the recesses 14 located at the leading side relative to the direction of flow is also given a jet like shape in this embodiment (see FIG. 9).

The embodiment of FIGS. 10 to 12 corresponds again substantially to the embodiment of FIGS. 4 to 6 whereby, however, in this embodiment the recesses 14 are shaped such that they are open against the trailing edge of the side walls 4 and 5. The shape of these recesses corresponds to the shape of the recesses 14 of the embodiment in accordance with FIG. 9.

Figure 13:
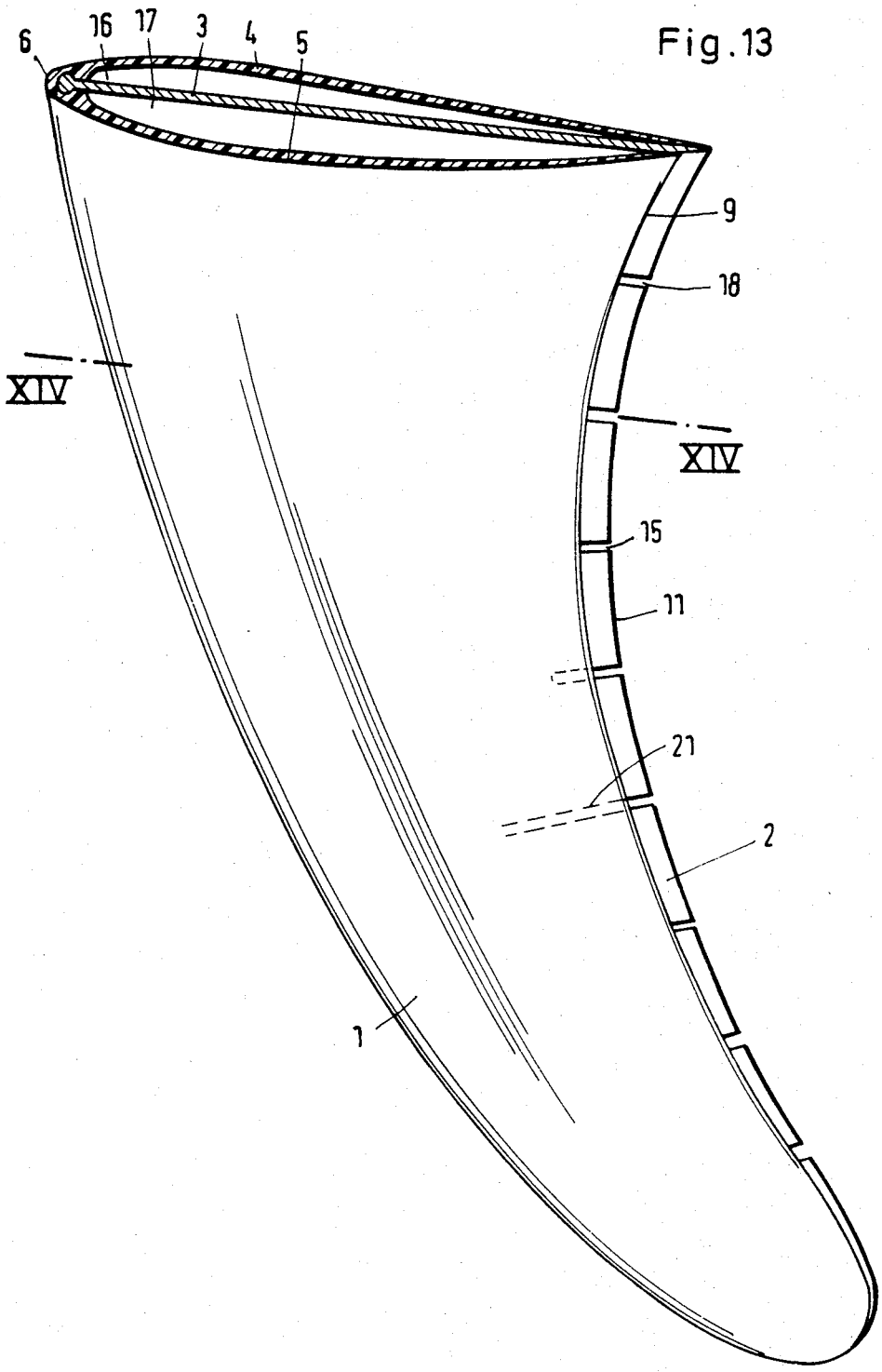
FIG. 13 is a view of a specifically preferred embodiment of the invention corresponding to the view of FIG. 1.
Figure 14:
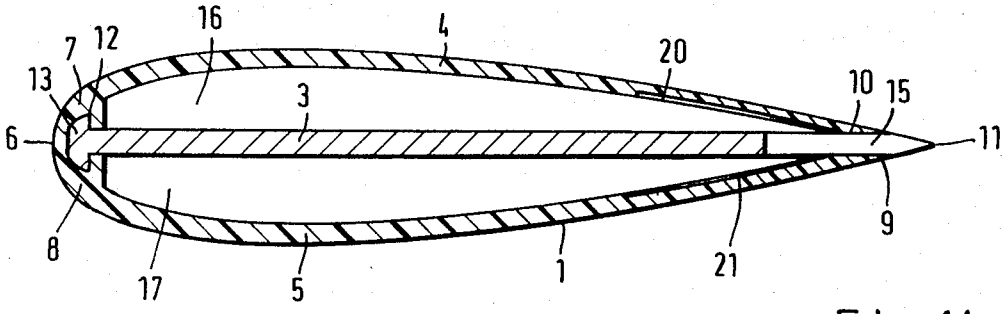
FIG. 14 is a view of a section along line XIV—XIV of FIG. 13.
Figure 15:
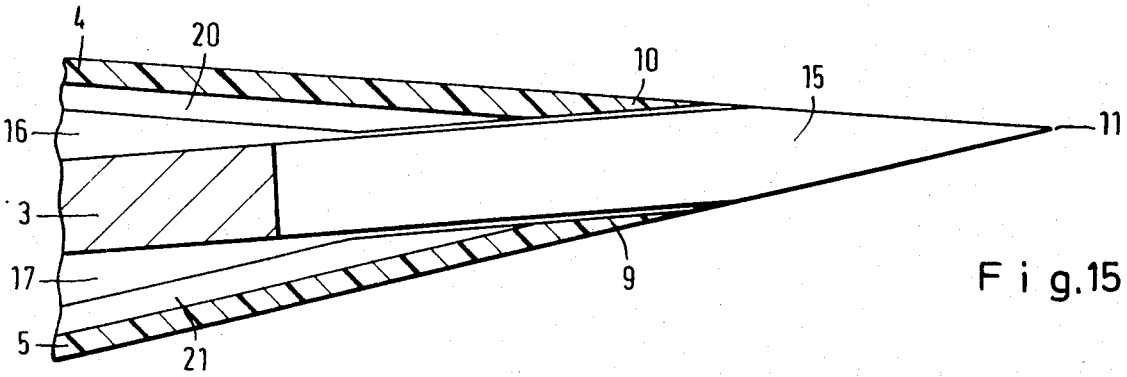
FIG. 15 shows on an enlarged scale a section of the trailing edge of the embodiment of FIG. 14.

A further preferred embodiment of the invention is shown in FIGS. 13 to 15, which embodiment corresponds to the other embodiments regarding the structural details with exception of the structure of the vacuum pumps 18.

The recesses 15 of this embodiment are arranged only at the trailing edge of the center wall 3. In the rest position in accordance with FIG. 13, i.e. when no flow velocity is present, the recesses 15 are partly covered by the uninterrupted trailing edges of the side walls 4, 5. FIG. 15 discloses specifically clearly that valve channels 20, 21 are located at the inner sides of the side walls 4, 5, which valve channels 20, 21 are aligned with the recesses 15. According to this construction the side walls 4 and 5 will function upon a changing of the profile as control valves in that if flowed against at an oblique angle and at a corresponding high deformation at the negative pressure side the respective void space 16 or 17 will be shut off against the vacuum pump 18 such that the total negative pressure will act only at the pressure side of the profile subject to the flow.

Figure 16:
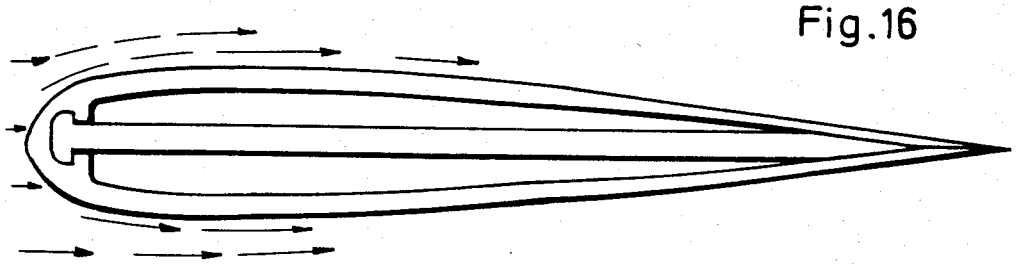
FIG. 16 is a schematic view of a section of a profile adjusting itself at higher velocities.
Figure 17:
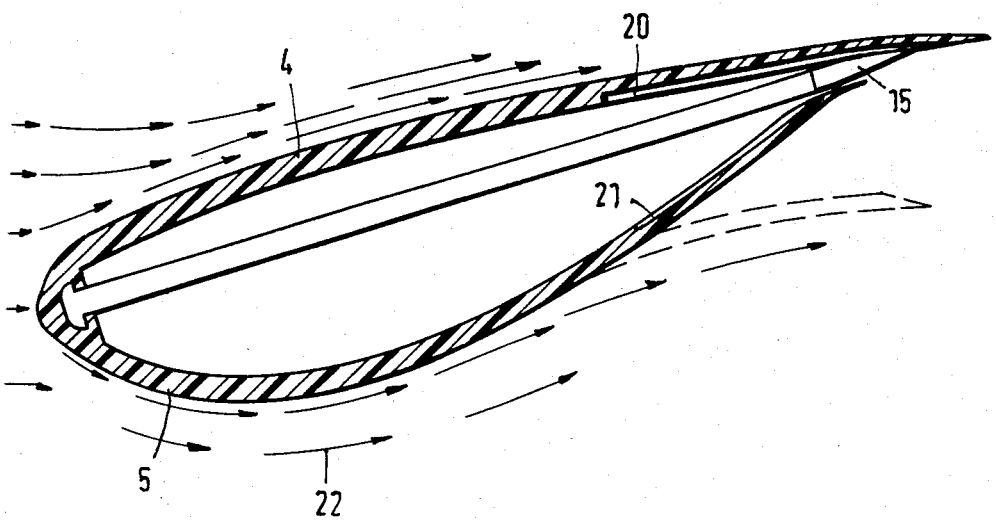
FIG. 17 is a schematic view of a section of the profile when flowed against at an oblique angle.

When viewing FIGS. 16 and 17, it is obvious that in case of an axiparallel flow the profile will merely be pulled into a somewhat thinner state.

In FIGS. 16 and 17 the flow conditions are schematically shown by the flow arrows 22.

According to FIG. 17 the void space is shut off against the vacuum pump 18 due to the control channel 21 as soon as the side wall 5 has been deformed at the negative pressure side of the profile subject to flow such that the total vacuum generated in the void space 16 acts upon the trailing edge 11. Therefore, the side wall 4 located at the leeward side will be pulled into an extremely flat profile which is preferred at the flow conditions existing thereat.

This embodiment according to which the negative pressure is eliminated due to the control valve function allows in addition the advantage that if, for instance, the negative pressure in the rear area outside of the side wall 5 (as shown in FIG. 17) tends to rise to a too high value, i.e. if the danger exists that a cavitation situation may be present, it is merely necessary to overcome the elasticity of the side wall 5 such that it may elastically move into the location and shape shown in FIG. 17. This will lead to an immediate equalization of the negative pressure which has been generated hydrodynamically.

Figure 18:
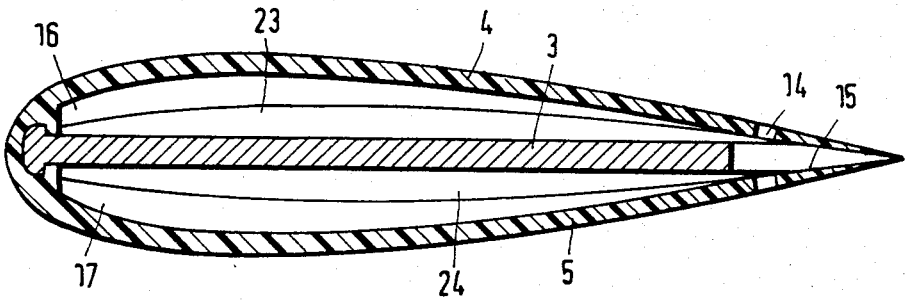
FIG. 18 is a view of a section corresponding to the view of FIG. 2 of a further embodiment of the invention.

In FIG. 18 a view of a section of a modification is shown which may be applied at all embodiments. According to this Figure, the center wall 3 is provided with stiffening ribs 23, 24 located at a respective distance from each other and above each other, which ribs 23, 24 limit the minimal flattest profile. In place of the ribs it is also possible to design the center wall 3 completely in shape of a profile.

The above described invention has been more closely explained based on a number of embodiments. The person skilled in the art of hydrodynamics will definitely be aware of many modifications and variations of these embodiments without departing from the basic thought of the invention.

All features and advantages of the invention, including structural details and spatial arrangements disclosed in the specification, in the claims and the drawings, may be of inventive nature as such or in an arbitrary combination.

While there are shown and described present preferred embodiments of the invention, it is to be distinctly understood that the invention is not limited thereto, but may be otherwise variously embodied and practiced within the scope of the following claims. Accordingly,

What is claimed is:

1. An apparatus for the stabilizing of the direction of travel of watercraft, specifically a sword or fin for sailboards having a guide plate extending from the bottom side of said watercraft into the water, which guide plate has a symmetrical airfoil profile cross-sectional shape, comprising two independently from each other flexibly deformable side walls defining the profile of said guide plate, the shape of said side walls in the prestressed condition due to their internal elasticity corresponding to an optimal profile for low flow velocities, which said side walls are designed such that they are deformable in accordance with prevailing pressures which change due to velocity of flow and/or due to angle of flow thereagainst;

said flexible side walls being mounted to a relative to the direction of flow leading edge of a rigid center wall, said flexible side walls abutting solely due to their inherent elasticity laterally at the area of the trailing edge described by said center wall of said apparatus, said side walls defining together with the two oppositely located surfaces of said center wall two substantially closed void spaces or cavities, respectively, recesses being arranged at the area defined by the lines of contact between said flexible side walls and said center wall, which said recesses are dimensioned such that they define together with the outer current of the water, water jet pumps.

2. The apparatus of claim 1, wherein said recesses are arranged within said side walls.

3. The apparatus of claim 1, wherein said recesses are arranged at the trailing edge of said center wall.

4. The apparatus of claim 1, wherein said recesses are arranged in said side walls and in said center wall such to form a jet pump acting simultaneously onto both said void spaces.

5. The apparatus of claim 1, comprising valve channels which are located at the inner surface of said side walls and in the area of their trailing edges, which said valve channels are in alignment with said recesses at said trailing edge of said center wall, whereby the arrangement is such that upon an exceeding of predeterminable profiles of said side walls said void space or void spaces, respectively, are shut off against said jet pumps.

6. An apparatus for the stabilizing of the direction of travel of watercraft, specifically a sword or fin for sailboards having a guide plate extending from the bottom side of said watercraft into the water, which guide plate has a symmetrical airfoil profile cross-sectional shape, comprising two independently from each other flexibly deformable side walls defining the profile of said guide plate, the shape of said side walls in the prestressed condition due to their internal elasticity corresponding to an optimal profile for low flow velocities, which said side walls are designed such that they are deformable in accordance with prevailing pressures which change due to velocity of flow and/or due to angle of flow thereagainst;

said flexible side walls being mounted to a relative to the direction of flow leading edge of a rigid center wall, said flexible side walls abutting solely due to their inherent elasticity laterally at the area of the trailing edge described by said center wall of said apparatus, said side walls defining together with the two oppositely located surfaces of said center wall two substantially closed void spaces or cavities, respectively, inner bracings being provided at said center wall whereby a limitation of a minimal profile is achieved.

7. The apparatus of claim 6, wherein said bracings are present as said center plate having a profiled shape.

8. The apparatus of claim 6, wherein said bracings are present in form of ribs mounted to said center plate.

9. An apparatus for stabilizing the direction of travel of watercraft comprising a guide device extending from a bottom side of the watercraft and having a longitudinal axis, a leading edge, and a trailing edge, said guide device comprising:

two independently from each other flexibly deformable side walls defining a profile of said guide device, said side walls being joined at said leading edge and free from each other at said trailing edge, said side walls having sufficient internal elasticity to hold their trailing edges adjacent said axis while allowing individual and asymmetric deformation of portions of said side walls between said leading edge and said trailing edge in accordance with prevailing pressures against said side walls solely due to velocity of flow and/or solely due to angle of flow thereagainst, and a rigid center wall aligned along said axis, said leading edge of said side walls being joined to a leading edge of said center wall, said trailing edges of said side walls only resting against a trailing edge of said center wall, said portions of said side walls defining together with two oppositely located surfaces of said center wall two substantially closed void spaces or cavities, respectively.

10. The apparatus of claim 9, wherein said side walls are integrally connected to each other by the intermediary of a formed body, which said formed body comprises a profiled channel for receiving a profiled section located at the leading edge of said center wall.

11. The apparatus of claim 9, wherein said center wall is manufactured of aluminum.

12. The apparatus of claim 9, wherein said side walls are manufactured of rubber.

13. The apparatus of claim 9, wherein said void spaces are empty.

14. The apparatus of claim 9, wherein said sidewalls are manufactured of a plastics material.

15. An apparatus for the stabilizing of the direction of travel of watercraft, specifically a sword or fin for sailboards having a guide plate extending from the bottom side of said watercraft into the water, which guide plate has a symmetrical airfoil profile cross-sectional shape, comprising two independently from each other flexibly deformable side walls defining the profile of said guide plate, the shape of said side walls in the prestressed condition due to their internal elasticity corresponding to an optimal profile for low flow velocities, which said side walls are designed such that they are deformable in accordance with prevailing pressures which change due to velocity of flow and/or due to angle of flow thereagainst;

said flexible side walls being mounted to a relative to the direction of flow leading edge of a rigid center wall, said flexible side walls abutting solely due to their inherent elasticity laterally at the area of the trailing edge described by said center wall of said apparatus, said side walls defining together with the two oppositely located surfaces of said center wall two substantially closed void spaces or cavities, respectively, said void spaces being filled in part by a compressible material.

* * * * *